US011024113B2

(12) United States Patent
Pececnik

(10) Patent No.: US 11,024,113 B2
(45) Date of Patent: Jun. 1, 2021

(54) TERMINAL, SYSTEM AND GAME PLAY METHOD FOR RANDOM NUMBER SELECTION EVENTS

(71) Applicant: Interblock d.d., Menges (SI)

(72) Inventor: Joze Pececnik, Kamnik (SI)

(73) Assignee: INTERBLOCK D.D., Menges (SI)

( * ) Notice: Subject to any disclaimer, the term of this patent is extended or adjusted under 35 U.S.C. 154(b) by 94 days.

(21) Appl. No.: 15/917,497

(22) Filed: Mar. 9, 2018

(65) Prior Publication Data

US 2018/0261041 A1 Sep. 13, 2018

Related U.S. Application Data

(63) Continuation of application No. 13/621,851, filed on Sep. 18, 2012, now Pat. No. 9,916,718.

(51) Int. Cl.
*G07F 17/32* (2006.01)

(52) U.S. Cl.
CPC ..... *G07F 17/3213* (2013.01); *G07F 17/326* (2013.01)

(58) Field of Classification Search
CPC ..... A63F 5/00; A63F 5/0005; G07F 17/32; G07F 17/3213; G07F 17/326
See application file for complete search history.

(56) References Cited

U.S. PATENT DOCUMENTS 4,494,197 A 1/1985 Troy et al.
5,647,798 A 7/1997 Falciglia
5,718,431 A 2/1998 Ornstein
5,755,619 A 5/1998 Matsumoto et al.
(Continued)

FOREIGN PATENT DOCUMENTS

EP 2228107 A1 9/2010
GB 2284499 A 6/1995
(Continued)

OTHER PUBLICATIONS

"Getting the Odds on your Side at Roulette" by Al Krigman posted Jul. 14, 1997 at http://www.krigman.casinocitytimes.com/article/getting-the-odds-o- n-your-side-at-roulette-5365.
Patent Cooperation Treaty International Searching Authority, Notification of transmittal of the International Search Report and the Written Opinion of the International Searching Authority, or the Declaration, dated Jan. 16, 2014, 12 pages.
(Continued)

*Primary Examiner* — Omkar A Deodhar
*Assistant Examiner* — Ross A Williams
(74) *Attorney, Agent, or Firm* — BakerHostetler

(57) ABSTRACT

A console for enabling play of a casino wagering game has: a video display screen; a player input system; a wager accepting and resolving system; a ball drop-and-capture gaming system; sensors for the gaming system; and a processor. Separate areas are provided on the video display screen for display of distinct results from at least two consecutive separate ball drop-and-capture events. The processor is configured to:

a) receive information from sensors as to results of each ball drop-and-capture event;

b) transmit viewable information to each separate area provided on the video display screen for each consecutive separate ball drop-and-capture event; and c) to compare all ball drop-and-capture events to a preselected number of memorialized ball drop-and-capture outcomes.

20 Claims, 3 Drawing Sheets

(56) References Cited

U.S. PATENT DOCUMENTS

| | | | | |
|---|---|---|---|---|
| 5,951,396 | A | 9/1999 | Tawil | |
| 6,059,659 | A * | 5/2000 | Busch | A63F 5/00 273/142 B |
| 6,079,711 | A | 6/2000 | Wei et al. | |
| 6,209,869 | B1 | 4/2001 | Mathews | |
| 6,257,980 | B1 | 7/2001 | Santini, Jr. | |
| 6,520,854 | B1 * | 2/2003 | McNally | A63F 5/00 273/142 B |
| 6,561,512 | B2 | 5/2003 | Luciano et al. | |
| 7,669,850 | B1 | 3/2010 | Miller | |
| 7,753,774 | B2 | 7/2010 | Gail et al. | |
| 8,007,355 | B2 | 8/2011 | Grubmiller | |
| 8,047,917 | B2 | 11/2011 | Kane et al. | |
| 8,070,579 | B2 | 12/2011 | Bienvenue et al. | |
| 8,172,683 | B2 | 5/2012 | Kelly | |
| 8,201,827 | B2 | 6/2012 | Weingardt | |
| 2002/0169017 | A1 | 11/2002 | Visoenik | |
| 2004/0077398 | A1 * | 4/2004 | Jarvis | G07F 17/32 463/17 |
| 2004/0251624 | A1 | 12/2004 | Hodapp et al. | |
| 2005/0285336 | A1 | 12/2005 | Ilievski | |
| 2006/0170154 | A1 | 8/2006 | Matsuno et al. | |
| 2007/0060262 | A1 | 3/2007 | Kosaka et al. | |
| 2008/0076539 | A1 | 3/2008 | Toyoda | |
| 2008/0254881 | A1 * | 10/2008 | Lutnick | G07F 17/3293 463/31 |
| 2008/0254884 | A1 | 10/2008 | Okubo | |
| 2010/0007773 | A1 | 1/2010 | O'Connell et al. | |
| 2010/0009744 | A1 | 1/2010 | Mugnolo et al. | |
| 2011/0281628 | A1 | 11/2011 | Sieka | |
| 2012/0112408 | A1 | 5/2012 | Poon | |
| 2014/0015194 | A1 | 1/2014 | Pececnik | |

FOREIGN PATENT DOCUMENTS

| | | | |
|---|---|---|---|
| GB | 2431016 | A | 11/2004 |
| WO | WO 2005/096095 | A1 | 10/2005 |

OTHER PUBLICATIONS

International Patent Application No. PCT/US2013/060383; Int'l Written Opinion and the Search Report; dated Dec. 20, 2013; 7 pages.

* cited by examiner

TERMINAL, SYSTEM AND GAME PLAY METHOD FOR RANDOM NUMBER SELECTION EVENTS

CROSS REFERENCE TO RELATED APPLICATIONS

This application is a continuation of U.S. patent application Ser. No. 13/621,851, filed Sep. 18, 2012, now U.S. Pat. No. 9,916,718, issued Mar. 13, 2018, the contents of which is incorporated herein by reference in its entirety.

BACKGROUND OF THE INVENTION

1. Field of the Invention

The present invention relates to gaming at terminals or banks of terminals, terminal design and construction, and gaming events played on the terminals.

2. Background of the Art

Many different varieties of games are played on terminal wagering systems in the gaming industry. A vast majority of games are played on a fairly uniform style of gaming terminal associated with slot machine games. The art work may vary based upon game themes, but the basic structure of the most common terminals produced by a variety of manufacturers barely changes among the sources. A typical Prior Art gaming terminal is shown in FIG. 1.

Although top boxes (often associated with bonus events or bonus games or special play display events) alter the appearance of the terminals by adding another stacked element to the apparatus, the underlying structure fundamentally remains the same.

Many different types of games are played on these gaming terminals, including variations on other casino type games, such as video poker, standard 3-reel or 5-reel slot machines, blackjack, keno, bingo and uniquely designed games for play on the terminals. Top box features such as the "Wheel of Fortune"® game add active elements of play to the top of the terminal or top of a bank of terminals.

There are not only variations within the generic types of games referred to as "Bingo," but all of them have a consistent underlying basis of play. A series of available frames or spaces within a closed set of outcomes is provided on a ticket, card, lottery ticket or other temporary or permanent memorialization of a partial selection of numeric (or alphanumeric) outcomes. There is a finite set of individual alphanumerics (for purposes or a typical example, there may be 90) and the memorialization (e.g., a printed card, or virtual card, or ticket) having a smaller set of frames or selections from the finite set. The general, typical bingo card, for example, may have a 5×5 set of frames (e.g., with the center frame being the "Free" space). Each card has random numbers from within subsets of the finite number (e.g., 18 numbers available for each column, out of a total of 89 or 90 numbers in the finite total).

In technical terms the generic game of bingo may be exemplary but not exclusively defined as including steps of:

a) A first finite closed set of numbers is provided as being available for individual event outcomes (alphanumerics);
b) A methodology is provided for selection of individual ones of the first finite closed set of numbers;
c) Where only a single card (or single terminal, ticket, etc,) is in play (as opposed to multiple players engaged in a speed bingo event), a second finite subset of active numbers is randomly selected from within the first finite closed set of numbers, and the selection process stopped);
d) The single card is provided (before, contemporaneously or subsequently to selection of the second finite subset) with a third finite subset from within the first finite closed set of numbers;
e) Correspondence between the second finite subset and the third finite subset is determined; and
f) The degree of correspondence between the second finite subset and the third finite subset determines winning, losing or tying outcomes in the "bingo" game. Where wagers have been placed, wager outcomes are determined from these game outcome determinations.

There is a particular variant of Bingo that is more common in Europe. A ticket (card, virtual ticket, etc.) is provided with specific numbers or specific sets and orders of numbers on a grid (e.g., three numbers, numbers in 2×3 grids, numbers in 3×3 grids, etc.). The numbers in the grid may be selected by a player or randomly provided (as the third finite subset of numbers). The second finite set of active numbers is then compared with the numbers of the third set in the grid and game event outcomes are determined.

Among the many game variants and terminal structure variants known in the field are at least among the following.

U.S. Pat. No. 8,201,827 (Weingardt) describes a bingo game and method in which bingo rules are used to simulate video poker and slot machine games. Players using linked terminals are assigned flashboards having multiple squares thereon, which squares have indicia thereon. If video poker is to be simulated, the indicia will be suit and value indicia of the type associated with playing cards. If slot machine play is to be simulated, the indicia will be of the like associated with slot machines, such as cherries, bars and bells. The calling of numbered bingo balls leads to the display to the player of corresponding indicia from numbered squares on the flashboard. A multiple overlapping ball draw may be utilized to accommodate slower and faster players, to allow overlapping games so that a slower player can have more time to play while a faster player can finish one game and commence another before the first game has closed. Where no player achieves a winning combination, an award can be provided based on a pre-determined value of indicia received by the player, including a near miss or a lowest hand. In one embodiment, the near-miss award may be paid from a progressive jackpot, to increase player excitement and to incentivize players to try for a near-miss hand.

U.S. Pat. No. 6,079,711 (Wei) describes a combination Bingo and Poker game. The game uses a game board (10) containing a matrix of Bingo places (16). The Bingo places each have a Bingo number (26) and playing card indicia (28). The game is played similarly to standard Bingo with the players marking the places on the game board as the numbers are selected by the host entity (12A). A player has a winning BINGO when the marked places form a winning Bingo configuration. The playing card indicia of the places of the winning Bingo configuration are then used to form a potentially winning Poker hand.

U.S. Pat. No. 8,172,683 (Kelly) describes a casino gaming system is disclosed that provides an opportunity to win a prize in response to game play, each game being played in exchange for monetary input. The gaming system includes a casino game server and a plurality of casino game units connected via a network. The game units each include a web browser. The game system enables a player to receive a prize at a casino game unit in response to winning game play, wherein the prize comprises a physical prize, coins, cash, or a ticket voucher for a physical prize, coins, or cash. The gaming system enables casino game units to request games from the game server over the network. The games may be downloaded over the network from the casino game server to the requesting game unit to be executed at the game unit and to be displayed in one or more web browsers.

U.S. Pat. No. 8,070,579 (Bienvenue) describes novel methods, devices and systems for mapping a variety of Class III game outcomes to a common set of bingo patterns. Each game theme may have a different entertaining display, based upon a corresponding Class III game. Preferably, each game theme will offer game play and paytable percentages closely matching those of the original Class III game. Some implementations provide a system wherein electronic gaming machines presenting entertaining displays of various Class III game themes are linked to a single bingo server. By linking many participating electronic gaming machines to a single server, some implementations of the invention allow all of the progressive contributions to be pooled into one large progressive jackpot, thereby making the game more attractive to players.

U.S. Pat. No. 8,007,355 (Grubmiller) describes an electronic roulette-type betting device and method. The device comprises a display unit and an associated display control unit for the graphic reproduction of a roulette bowl device together with a rotating ball, at least one input unit for inputting symbols on which to bet, a time control unit for setting time limits for the betting process, said limits being reproducible on the display unit as ball rotating limits by means of the display control unit, an odds determining module that determines different winning odds for the individual symbols according to the pre-defined time limits supplied by the time control unit, a random generator for producing and transmitting random variables as winning symbols, and a comparison and evaluation unit for comparing the symbols bet on with winning symbols, and for determining and displaying wins in the event of a correlation of the symbols.

U.S. Pat. No. 5,647,798 (Falciglia) describes a method and apparatus for playing the game of bingo on a slot machine. The bingo slot machine includes a display matrix capable of generating random numbers and a plurality of wheels, the number of wheel corresponding to the number of columns used in the display matrix, and a slot machine activating arm for use to activate the wheels as would be typically found in a slot machine. The game is played by pulling the arm and activating the wheels which stop at random wheel positions. The positions are then compared to the display matrix in a fashion similar to the game of bingo.

U.S. Pat. No. 5,755,619 (Matsunoyo) describes a bingo game machine, in which a plurality of randomly selected special signs are compared with signs on a bingo card and a winner of a game is decided in accordance with correspondence of the signs, includes: a display unit which displays a bingo card image including squares arranged in a matrix and allotted with different signs; and a changer which changes the sign in a predetermined square of the bingo card image. The bingo game machine randomly selects special signs are compared with signs on a bingo card and a winner of a game is decided in accordance with correspondence of the randomly selected signs with the signs on the bingo card. The machine has: a display unit for displaying a bingo card image including squares arranged in a matrix and for allotting signs to each of said squares such that no two of said squares have the same sign, said signs allotted to said squares being included in a pool of signs from which said randomly selected special signs are selected; and a changer for changing the allotment of said signs in said squares of the bingo card image in a single operation by shifting signs from one square of said squares to another square of said squares.

U.S. Pat. No. 5,951,396 (Tawil) describes an apparatus (10) for monitoring and registering a bingo game includes an arrangement for entering and storing a game card identifier (32) associated with each game card (30) issued in a game sequence. The apparatus (10) also includes storage (16) for storing the card pattern of each card issued in the game sequence, along with all of the symbols drawn by a game operator during the game sequence. A winning pattern comparing arrangement is connected to the card pattern and drawn symbol storage (16) and operates to compare the potential winning symbol patterns of each card issued in the game sequence with each drawn symbol immediately after the symbol is drawn. The comparison is to determine each match between the drawn symbol and a card symbol and discover the winning card in the game sequence. The apparatus (10) further includes a display for displaying the card identifier of the winning card or cards to the game operator and players.

U.S. Pat. No. 6,561,512 (Luciano) describes an electronic lottery game system utilizing multiple player-activated video terminals that are linked to computers performing centralized game draw and accounting functions. Each player places a wager and selects his lottery draw choices. The system enrolls the player in a future lottery game after the player makes his choices. The system automatically draws the lottery numbers. The result of the selected game is displayed at the player's terminal in such a manner as to provide the excitement of a real time game.

U.S. Pat. No. 4,494,197 (Troy) describes a wagering system having a central processor and a plurality of playing consoles remote therefrom with said console capable of providing data inputs to the central processor, with such data inputs including identification of the playing console, the player, amount played, and games selected which may be an instantaneous game or a delayed game with said central processor being interconnected to the playing console via a multiplexing preprocessing arrangement, said central processor having a means of determining a winning play based upon the time of transmittal of the data or on a random basis, with the player console having a means capable of providing a printed record of the play to the player along with a verification of a win or a loss.

U.S. Pat. No. 6,257,980 (Santini) describes method and apparatus for identifying a winner in a bingo game. Players may obtain bingo cards from point-of-sale (POS) terminals that physically prints bingo cards for players in an embodiment where the player appears in person to purchase tickets, or from point-of-sale (POS) terminals that permit players to play bingo in an on-line environment. A game processor maintains a linked list identifying each card in play containing each possible value. Each entry in a linked list includes a pointer to the next element in the linked list. Each bingo card is represented as a bitmap containing an entry corresponding to each square on the bingo card. Each entry in the linked list also identifies the particular square on the bingo card containing the corresponding value, thereby allowing the appropriate entry in the corresponding bitmap to be identified. As each number is drawn, the game processor utilizes the linked list to identify all of the bingo cards in play having the drawn number. As each card containing the drawn number is identified, the corresponding entry in the bitmap is marked. Each possible winning pattern in a bingo game is likewise represented as a bitmap. If a bit in the winning bitmap is set to a value of 1, then the corresponding square must be set on a player's bingo card in order to match the pattern. Winning players are identified by comparing the card bitmap to each of the possible winning bitmaps. If all the 1's that are set in any bitmap for a winning pattern are also set in the card bitmap, then the card is a winning card.

SUMMARY OF THE INVENTION

The present invention includes a console for use by one or more players that enables play of a gaming variant of bingo. The console enables play of a casino wagering game using at least components of:

a video display screen;

a player input system;

a wager accepting and resolving system;

a ball drop-and-capture gaming system;

sensors for the gaming system; and a processor.

Separate areas are provided on the video display screen for display of distinct results (individual ball drop-and-captures with associated alphanumeric results) from at least two consecutive separate ball drop-and-capture events. The processor is configured to:

a) receive information from sensors as to results of each ball drop-and-capture event (e.g., identify specific alphanumeric results);

b) transmit viewable information (image data, images, electronic data of images, etc.) to each separate area provided on the video display screen for each consecutive separate ball drop-and-capture event; and c) compare all ball drop-and-capture events to a preselected number of memorialized ball drop-and-capture outcomes. This last is done to determine relative win, tie or lose events in a wager.

The method of play of particular games of "bingo" variants on the apparatus in which Player controls and inputs are used to initially position or finally position the alphanumeric display component of the ball drop-and-capture gaming system. After setting the alphanumeric display, the ball is spun about the rim or ledge and then drops into a capture compartment or canoe and identifies a single alphanumeric. Games are played by a single ball being dropped, recaptured and redropped up to the predetermined number of drops in a game, or by dropping balls, one-at-a-time, until a total predetermined number of balls for play of the game or games has been completed.

DETAILED DESCRIPTION OF THE INVENTION

Figure 1A:
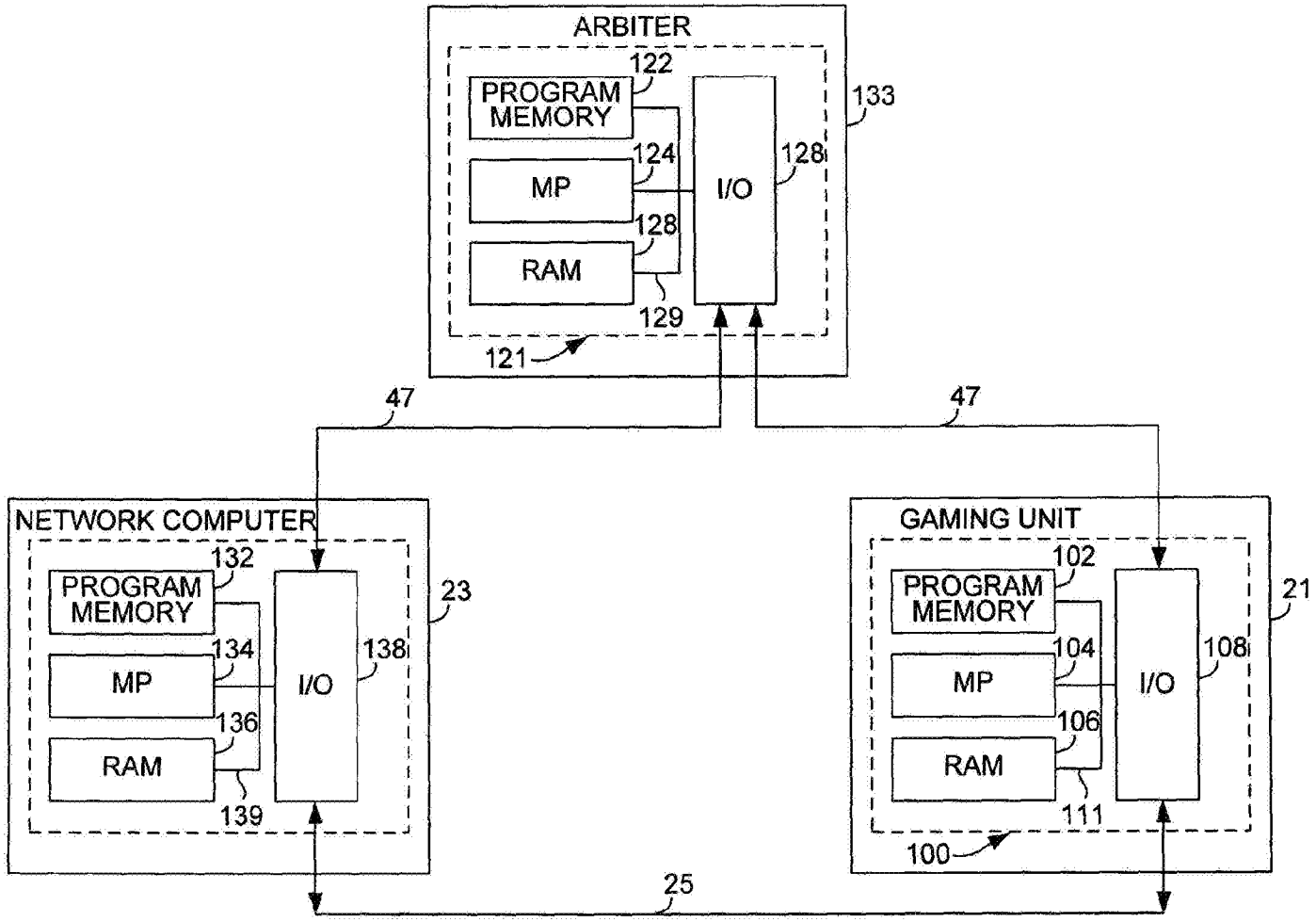
FIG. 1A is a schematic drawing of a Prior Art intelligence system usable within the scope of the present technology showing interconnection among an Arbiter 133, an arbiter controller 121 that may comprise a program memory 122, a microcontroller or microprocessor (MP) 124, a random-access memory (RAM) 126 and an input/output (I/O) circuit 128, all of which may be interconnected via an address/data bus 129.

The present invention includes a console for use by one or more players that enables play of a gaming variant of bingo. The console enables play of a casino wagering game using at least components of:

a video display screen;

The video display system may be provided by any available commercial quality technology, such as plasma screens, CRTs, semiconductor screens, liquid emitting diodes and the like. The only technical requirements are that it provides sufficient image quality and resolution so that the viewing experience and ability to read alphanumerics on the display is not impaired.

a player input system;

The player input system may be any player input system as known or used in the gaming art. This could include the traditional buttons, touch-screen information entry, keyboard, mouse-screen combinations, joy sticks, voice data entry and the like. Combinations of these elements, especially both touch-screen input and button input are particularly useful as will be described in greater detail herein.

a wager accepting and resolving system;

Any wager accepting system and resolution system that could meet gaming regulation requirements anywhere in the world, and especially within the United States, is acceptable. The wager system will usually include a processor and accounting functionality. Wagers may be entered and recognized from coins, tokens, chips, currency, debit card credit, charge card credit, electronically accessed gaming facility credit or funds, ticket-in-ticket-out technology and the like.

a ball drop-and-capture gaming system;

Ball drop games and events can be implemented in a number of different ways. A simple way is similar to roulette ball drop systems, with or without the need for spinning the ball around a ledge or manually dropping a ball. A preferred physical ball drop methodology is to have a central spinning wheel distribution of ball receptor holes or slots or canoes or other capture areas distributed around the wheel. The distribution may be weighted or proportional (unweighted and evenly distributed) about the wheel. The wheel should be relatively level, although the systems may tolerate some or significant deviation from horizontal for aesthetic purposes. The wheel is spun and a ball is released at a random time and/or random position about the wheel. Friction and impact with elements on the wheel slow movement of the ball until it falls into a single ball capture area or element. The capture position or capture area is associated with an alphanumeric that is used in the play of the game as an event outcome, but not necessarily a game outcome. That is, just as where a single number-letter combination is called in the play of ordinary Bingo games is one of a number of game events that occur during a game, it is not a game ending event until it is the last number-letter combination to be called. At the conclusion of the game, one or more balls will be seated in defined locations within the wheel.

The balls may be used as multiple balls at a time, individual balls in a sequence, or one ball may be used and reused (upon return from a first and/or second ball securing drop-and-capture event. This can be readily understood from considering older and modern pin-ball games. In these types of games, multiple balls may be present on the same field of play at the same time, individual balls may be dropped and captured and remain on the field at the same time, or an individual ball may traverse the field, be captured, and then be returned into the game system to be redistributed again across the field. The balls may be temporarily captured within a hole or space, and then released from the temporary capture into a ball return system (as is conventionally used in automated roulette games and pin ball games). Even where multiple balls are present on the game field at the conclusion of a game, they must eventually be automatically returned into a start, pre-drop position, before a next game is initiated. These fairly common ball return systems can be used for that type of device.

sensors for the gaming system;

There must be sensors within the system to at least identify the particular capture area into which a ball has been captured so that a resulting event outcome (e.g., selection of a particular alphanumeric) can be determined to further game play. The sensors may be opto-electrical sensors, pressure sensors, cameras, light-interrupt sensors, and any other sensor that can detect the presence of a ball at a particular location within particular slots in the roulette wheel. There may be optical sensors, opto-electrical sensors, pressure or weight sensors, cameras, readers, scanners and the like used to determine the final location of the ball within a capture area relative to an event outcome alphanumeric. An alternative ball drop-and-capture system is described in copending U.S. patent application Ser. No. 13/547,271 (Pececnik) filed 7 Jul. 2012, which is incorporated herein in its entirety by reference. In that system, a final alphanumeric outcome is determined by a random number generator, a ball is dropped into a rotating wheel with ball capture areas, the position of the captured ball is identified, and the wheel is then continued to be rotated and eventually stopped with a processor aligning the ball in the capture position with the specific alphanumeric (on a surrounding array) that was randomly selected by the random number generator. The system also then uses conventional automatic ball return technology to reset a start of a game.

a processor.

The processor, its functional capabilities with respect to game play, electronics display, wagering control and the like is described in detail elsewhere herein. Separate areas are provided on the video display screen for display of distinct results (individual ball drop-and-captures with associated alphanumeric results) from at least two consecutive separate ball drop-and-capture events. The processor is configured to:

a) receive information from sensors as to results of each ball drop-and-capture event (e.g., identify specific alphanumeric results);

b) transmit viewable information (image data, images, electronic data of images, etc.) to each separate area provided on the video display screen for each consecutive separate ball drop-and-capture event; and c) compare all ball drop-and-capture events to a preselected number of memorialized ball drop-and-capture outcomes. This last is done to determine relative win, tie or lose events in a wager.

A further understanding and appreciation of the technology enabled herein will be appreciated by reference to the Figures.

Figure 2:
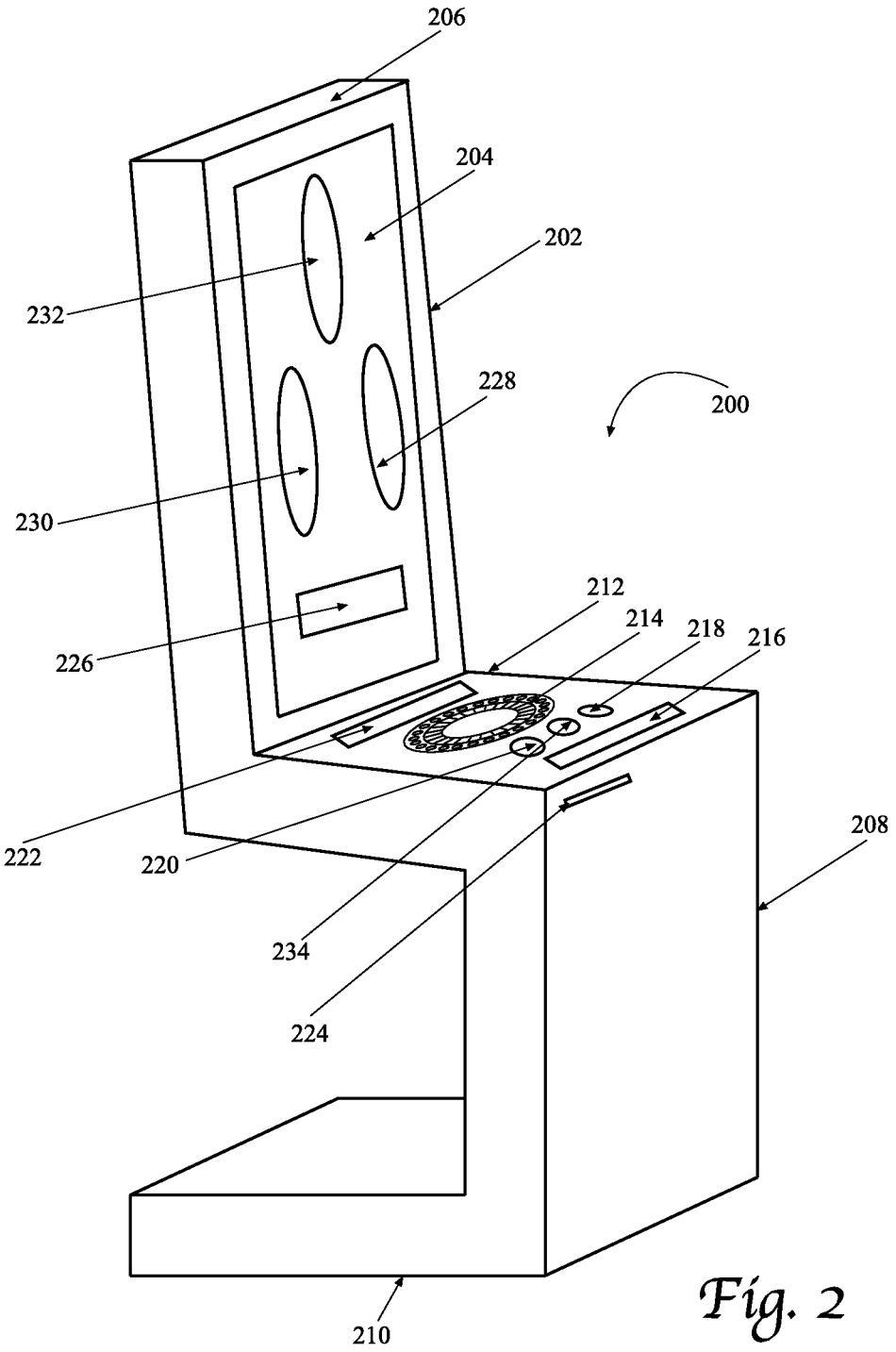
FIG. 2 shows a perspective view of a console according to the present technology.
Figure 3:
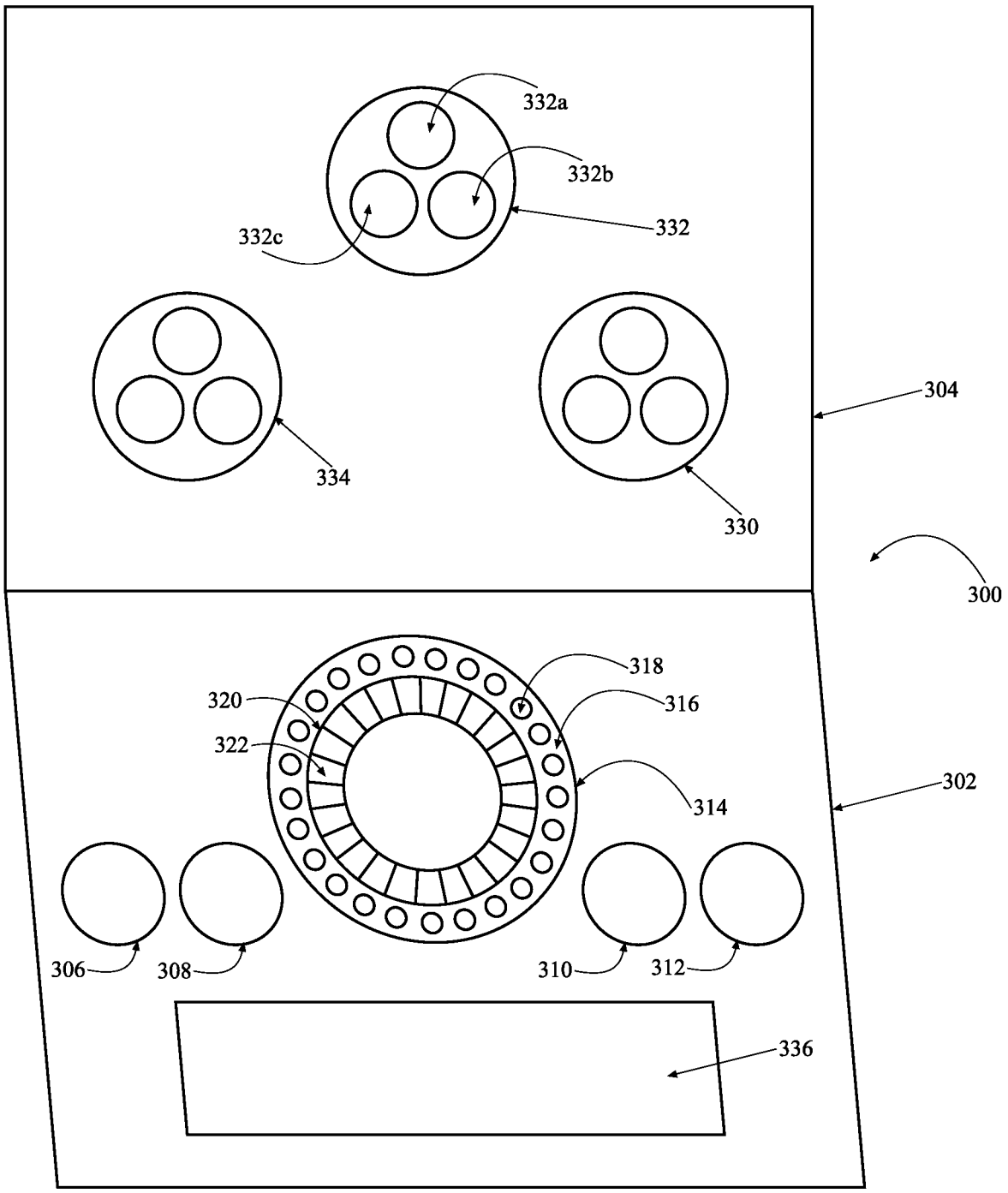
FIG. 3 shows a front view of the display screen and player input system of a console according to the present technology.

FIG. 2 shows a perspective view of a console 200 according to the present technology. The console 200 is shown with an upright display panel 202, a video display screen 204 on the upright display panel 202, and a console top 206 atop the video display panel 202. A support frame leg 208 and foot 210 supports the console 200. A game event and player input area 212 is shown in a relatively horizontal position in the console 200. The more important element in the game event and player input area 212 with respect to being horizontal is the wheel and ball drop-and-capture element 214 as described previously. Player input controls 216 as a touch-screen entry and 218, 220 as buttons on the game event and player input area 212 are shown. Additional display or data entry may also be available in area 222. A ticket output panel 224 is also shown on the console 200.

The console system may enable play of a game in the following non-limiting manner, which is only one of a number of game options that may be played on the system. A wager is received by entry into the player position user entry panel 216. The wager memorializes (for at least one game event outcome and resolution) a set of alphanumeric outcomes as a set, a line or a grid, which may be displayed on the video display panel 204 and/or printed as a ticket and dispensed through ticket output panel 224. A printing element (not shown) would then be required within the console, unless pre-made random tickets were available for distribution from a collection of preprinted tickets. The memorialization can be for any number, any sequence of numbers and sequence of appearance of numbers, specific alphanumerics and/or colors, the appearance of specific alphanumeric events on a first, second, third or other spin and the like. After the wager has been placed, where a player has selected a choice of memorialized outcomes or the processor has randomly selected or randomly provided a set of memorialized outcomes, the game may begin.

One format of game play within the generic class of "Bingo" games, especially as played in Europe, includes the following. The memorialized set of (for example) three consecutive outcomes or three collective outcomes is chosen by a player through the player interface. For example, a first outcome (which may be displayed in a first field displaying the first outcome 232) is selected by use of various player input controls 216, 218 and 220. The second and third selections are chosen by the same or remaining various input controls 216, 218 and 220 that were used or were not used in making the first or earlier selections. These input controls 216, 218 and 220 may alternatively or additionally be used as controls to initiate spinning and ball drop-and-catch steps for the ball drop-and-catch system 214.

One method of play can be as follows, using the described equipment. After the ager has been placed, button 218 is used to select a first ball drop-and-catch outcome to be displayed in field 232 on display screen 204. The game may be started then, or the additional selections (if any) for second and third ball drop-and-catch events may be then made. In this game, signals from the player input control 220 is used to select a predicted second event outcome to be displayed in field 230 after a second ball drop-and-catch event, and player input control 234 is used to select a third predicted event to be displayed in field 230 after a third ball drop-and-catch event outcome. After selections of outcomes are closed and the memorialization has been produced by display on filed 222 (for example) or by printing a ticket dispensed through ticket output 224, the game may be initiated. The processor (not shown) locks further selections of outcomes for wagering, and the player input controls 218, 220 and 234 may then be converted to inputs initiating individual ball drop-and-capture events. Either of the player input controls 218, 220 and 234 may be selected to initiate an outcome event specific to the respective display fields 228, 230 and 232. One or more ball drop-and-catch events may be used for each of the respective display fields 228, 230 and 232. For example, if there are eighteen (18) numbers available for each of the respective display fields 228, 230 and 232, there may be 2, 3, 4 or more ball drop-and-catch events for each field. The ball drop-and-catch events may be simultaneously provided (e.g., 2, 3, 4 or more balls dropped at the same time) or sequential with a single ball repeatedly dropped or multiple balls dropped one at a time or in subsets less than the entire set of balls.

After the outcome of the final set of ball drop-and-catch events, the processor evaluates the collective of end results with the memorialization and determines if there was a winning, tying or losing event and resolves the wager. Where a tick has been used, the ticket is reinserted into the device or another device connected to a processor that can identify a specific wagering event and result that is tied to that ticket. The ticket may bear a unique identification or code for later evaluation. The ticket may be used in one or more (consecutive) games played on the device, even in the absence of the player. For example, the alphanumerics on the memorialization may have sufficient wager sets available with them to play two or more consecutive games at a fixed wager. For example, with three numbers in a grid for each of the event outcomes displayed on the respective display fields 228, 230 and 232, a wager of thirty units (with three units wagered on each complete game, one unit on each display outcome) will sustain ten consecutive games on the console, even when the game is being played or is initiated by a third party. The processor retains stored accounting data of the game event and can resolve the wager upon later scanning and identification of the ticket.

Figure three shows a front view of the combined front of the console 300 with the display screen 304 and the player input system and ball drop-and-capture area 302. There are a set of player input controls 306, 308, 310 and 312 which may be buttons, knobs, touch-screen controls and the like. A specific display and/or touch-screen area 336 is also shown. The ball drop-and-catch system 314 is shown as having an outer section 316 with distinct elements 318, and an inner section 320 having distinct elements 322. The three event outcome display areas 330, 332 and 334 are shown with three distinct individual alphanumeric ball drop-and-catch event outcome display areas (e.g., 332*a*, 332*b* and 332*c*). By activating any of player input control areas 306, 308, 310 and/or 312, a wager or wagers may be placed on any one of the ball drop events displays 330, 332 and/or 334 for one, two or three outcomes. For example, by appropriate exercise of the player input control area 306, 308, 310 and/or 312 and even additionally 336, a player may wager on one or more event outcomes from within each display area, combinations of display areas and the like. Betting combination examples may include wagers such as all three numbers within 332, one number from within each of 330, 332 and 334, any two numbers within 334, any two numbers from within each of 330, 332 and 334, and any other possible combination for which probabilities and wager tables are provided through a game controller in or associated with the processor.

Each one of the ball drop events displays 330, 332 and/or 334 may be artificially indicated with a color or alphanumeric or image or theme to distinguish the display areas and associate them with specific ball drop-and-catch events. For example, each one of the ball drop events displays 330, 332 and/or 334 may be red, green or blue, and the player input control areas 306, 308, 310 and/or 312 may each select a next spin event wager respectively for the red, green, blue or all display areas.

Many different variations of games and bonuses may be played and provided on this equipment. The apparatus need not be limited to a single game.

Among the game and bonus possibilities are at least the following:

Single number play—one or more wagers may be at risk in the play of a single number for a single spin or one of the wheel displays. There may be a single wager (or multiple wagers) at risk for that particular selected number being randomly provided for wheel 1, wheel 2 or wheel three. The multiple wagers may be equally distributed (e.g., multiples of three units of wagers equally distributed across the three number wheels) or weighted among the wheels (e.g., 3 units on wheel number 1, 2 units on wheel number 2 and 1 unit on wheel number 3).

Multiple number sets and multiple wheel play—different numbers or sets of numbers are selected for each wheel and each wheel will have a separate payout rate.

Single number sets and multiple wheels—A single set of multiple numbers is selected and wagers are placed on one, two or three wheels.

Progressive number sets—Numbers are wagered on a first wheel and if a minimum qualifying set of numbers is reached, a wager on the second (then possibly the third, again with a qualifying number of numbers selected) wheel is activated, preferably at a higher payout according to a table.

Semi-Progressive number sets—Sets of numbers are wagered on all three wheels. If a minimum number of matches (e.g., 2/3, 3/6, etc.) on the first wheel, the payoff for matches in the second (and/or third) wheel become higher. If there is no "minimum" match, then there is no payoff on the first wheel and the payoff rate on the second wheel might be the same as the original payoff rate on the first wheel. For example, if the payoff on the first wheel were 15:1 for one number (out of an original three selected), 220:1 for two numbers (again out of an original three selected) and 300:1 for three numbers; the payoff on the second wheel might be the same if there were only a single number match on the first wheel and then 25:1 for one number, 500:1 for two numbers and 800:1 for three numbers if 2 or 3 numbers had been matched on the first wheel. This number may be varied according to probabilities, statistical analysis, game design, numbers of selections, numbers of available numbers and intended casino hold rates.

Bonus games—Any of these games or variants could be bonus games, or could be bonus games with the three-wheel bingo games as described herein. For example, if a player qualified for a bonus game by meeting certain parameters (e.g., at least one number selected in each wheel, at least one number selected within each wheel AND a total number of four numbers selected, at least one number selected within each wheel AND a total number of five numbers selected, at least one number selected within each wheel AND a total number of six numbers selected, and other qualifying variations, the game could then default into a bonus event. This could be a replay game, multiple free play games, an additional number provided in an existing game, another game with a potentially higher award available, etc. As video formats allow great flexibility, the entire game play format described above could be downloaded or shown as a bonus event in any existing or underlying game play. Thus, as opposed to something like the "Wheel of Fortune"® game play, the above bingo event would be displayed, with touch areas on the player input section made available for player input. The bonus could have 1, 2 or 3 spins, or progress through three spins depending upon a level of success on each wheel spin, much as with any of the games individually described above, but now used as a bonus.

A preferred way of operating the device is to give the appearance of a player setting the position of the alphanumeric wheel in advance of the ball drop. This can be done with a physical wheel or with a virtual wheel, or with a virtual display of alphanumerics about a ball catch array with a physical ball.

For example, there may be an alphanumeric display of (for example) thirty six numbers with thirty-six associated ball catch positions and a ball drop position. The apparatus may randomly rotate the alphanumeric display (and optionally the ball catch positions within it or separately from the alphanumeric display) to place the alphanumeric display at an angular positioning, with, for example, the alphanumeric 7 at the 0 degree rotation position (e.g., 12 o'clock. The processor randomly positioning the alphanumeric display may put the alphanumeric 7 at 10 degrees, 20 degrees, 30 degrees . . . etc. through 350 degrees (as 360 degrees is also 0 degrees on a fixed circle). If the player wants a further change in the position of the alphanumeric display, there may be a spin button or spin player data entry command that will again randomly rotate the alphanumeric display. It is also possible, in both physical wheel and virtual wheel format to have the player controls be capable of specifically positioning the alphanumeric display. Therefore, if the player operating the control wants the alphanumeric 7 exactly at 20 degrees, the player input control is used to direct that specific positioning of the alphanumeric 7. If the alphanumeric display has a fixed order of numbers, only the rotation of the wheel may be controlled. If, however, the alphanumerics are display by virtue of a display of numbers (e.g., 7-segment display, LED display, liquid crystal display, etc.), then the processor may randomly assign numbers, the player input controls may scramble the numbers, or the player can designate the position of the numbers, before the ball approaches a drop into a ball control or ball catch area. In some jurisdictions, the alphanumeric display must have a fixed position or at least a fixed orientation before the ball is dropped. In those cases, the rotational position of the wheel and/or the position of the alphanumerics on the wheel must be fixed, then the ball spun and released.

With a completely electronic display and player input controls, the player may select from among preexisting patterns available on the system (e.g., 1, 2, 3 . . . 36; 1, 3, 5, . . . 35, . . . 2, 4, 6, . . . 36; etc.) or may even enter a specific desired pattern. This last is time consuming, so a player may be able to do it a limited number of times within a session or have to pay a premium for extra selections.

Apparatus and Software Components

U.S. Pat. No. 7,753,774 (Gail) enables NETWORK SYSTEMS, especially as described in the Figures and specification thereof. These network systems, and the software and processor disclosed therein may be used in enabling the apparatus and methods of the present technology. FIG. 1A is a block diagram of a Prior Art simplified communication topology between a gaming unit 21, the network computer 23 and the Arbiter 133. Although only one gaming unit 21, one network computer 23 and one Arbiter 133 are shown in FIG. 1A, it should be understood that the following examples may be applicable to different types of network gaming devices within the gaming network 12 beyond the gaming unit 21 and the network computer 23, and may include different numbers of network computers, gaming security arbiters and gaming units. For example, a single Arbiter 133 may be used for secure communications among a plurality of network computers 23 and tens, hundreds or thousands of gaming units 21. Likewise, multiple gaming security arbiters 46 may be utilized for improved performance and other scalability factors.

Referring to FIG. 1A, the Arbiter 133 may include an arbiter controller 121 that may comprise a program memory 122, a microcontroller or microprocessor (MP) 124, a random-access memory (RAM) 126 and an input/output (I/O) circuit 128, all of which may be interconnected via an address/data bus 129. The network computer 23 may also include a controller 131 that may comprise a program memory 132, a microcontroller or microprocessor (MP) 134, a random-access memory (RAM) 136 and an input/output (I/O) circuit 138, all of which may be interconnected via an address/data bus 139. It should be appreciated that although the Arbiter 133 and the network computer 23 are each shown with only one microprocessor 124, 134, the controllers 121, 131 may each include multiple microprocessors 124, 134. Similarly, the memory of the controllers 121, 131 may include multiple RAMs 126, 136 and multiple program memories 122, 132. Although the I/O circuits 128, 138 are each shown as a single block, it should be appreciated that the I/O circuits 128, 138 may include a number of different types of I/O circuits. The RAMs 124, 134 and program memories 122, 132 may be implemented as semiconductor memories, magnetically readable memories, and/or optically readable memories, for example.

Although the program memories 122, 132 are shown in FIG. 1A as read-only memories (ROM) 122, 132, the program memories of the controllers 121, 131 may be a read/write or alterable memory, such as a hard disk. In the event a hard disk is used as a program memory, the address/data buses 129, 139 shown schematically in FIG. 1A may each comprise multiple address/data buses, which may be of different types, and there may be an I/O circuit disposed between the address/data buses.

As shown in FIG. 1A, the gaming unit 21 may be operatively coupled to the network computer 23 via the data link 25. The gaming unit 21 may also be operatively coupled to the Arbiter 133 via the data link 47, and the network computer 23 may likewise be operatively coupled to the Arbiter 133 via the data link 47. Communications between the gaming unit 21 and the network computer 23 may involve different information types of varying levels of sensitivity resulting in varying levels of encryption techniques depending on the sensitivity of the information. For example, communications such as drink orders and statistical information may be considered less sensitive. A drink order or statistical information may remain encrypted, although with moderately secure encryption techniques, such as RC4, resulting in less processing power and less time for encryption. On the other hand, financial information (e.g., account information, winnings, etc.), game download information (e.g., game software and game licensing information) and personal information (e.g., social security number, personal preferences, etc.) may be encrypted with stronger encryption techniques such as DES or 3DES to provide increased security.

As disclosed in further detail in the Arbiter Application, the Arbiter 133 may verify the authenticity of each network gaming device. The Arbiter 133 may receive a request for a communication session from a network device. For ease of explanation, the requesting network device may be referred to as the client, and the requested network device may be referred to as the host. The client may be any device on the network 12 and the request may be for a communication session with any other network device. The client may specify the host, or the gaming security arbiter may select the host based on the request and based on information about the client and potential hosts. The Arbiter 133 may provide encryption keys (session keys) for the communication session to the client via the secure communication channel. Either the host and/or the session key may be provided in response to the request, or may have been previously provided. The client may contact the host to initiate the communication session. The host may then contact the Arbiter 133 to determine the authenticity of the client. The Arbiter 133 may provide affirmation (or lack thereof) of the authenticity of the client to the host and provide a corresponding session key, in response to which the network devices may initiate the communication session directly with each other using the session keys to encrypt and decrypt messages.

Much gaming content is now provided on or through the internet. To enable the consoles and games of the present technology to be played, downloaded, controlled and/or monitored through modern technology, the following enabling apparatus/system disclosure should be considered.

Any operating system component would be an executable program component facilitating the operation of the Information Comparator system controller. Typically, the operating system facilitates access of I/O, network interfaces, peripheral devices, storage devices, and/or the like. The operating system may be a highly fault tolerant, scalable, and secure system such as Apple Macintosh® OS X (Server), AT&T Plan 9, Be OS, Linux, Unix, and/or the like operating systems. However, more limited and/or less secure operating systems also may be employed such as Apple Macintosh®OS, Microsoft® DOS, Microsoft Windows® system 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the Information Comparator system controller to communicate with other entities through a communications network. Various communication protocols may be used by the Information Comparator system controller as a subcarrier transport mechanism for interaction, such as, but not limited to: multicast, TCP/IP, UDP, unicast, and/or the like.

Information Server

An information server component used preferably as the computer in the above described methods and apparatus is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C #, Common Gateway Interface (CGI) scripts, Java, JavaScript, Practical Extraction Report Language (PERL), Python, WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the Information Comparator system controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/mylnformation.html" portion of the request and resolve it to a location in memory containing the information "mylnformation.html." Additionally, other information serving protocols may be employed across various ports, e.g., FTP communications across a port, and/or the like. An information server may communicate to and/or with other components in a component collection, including itself, and/or facilities of the like. Most frequently, the information server communicates with the Information Comparator system database, operating systems, other program components, user interfaces, Web browsers, and/or the like.

Access to the Information Comparator system database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the Information Comparator system. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the Information Comparator system as a query. Upon generating query results from the query, the results are passed over the bridge mechanism, and may be parsed for formatting and generation of a new results Web page by the bridge mechanism. Such a "new results" Web page is then provided to the information server, which may supply it to the requesting Web browser.

Also, an information server may contain, communicate, generate, obtain, and/or provide program component, system, user, and/or data communications, requests, and/or responses.

User Interface

The function of computer interfaces in some respects is similar to automobile operation interfaces. Automobile operation interface elements such as steering wheels, gearshifts, and speedometers facilitate the access, operation, and display of automobile resources, functionality, and status. Computer interaction interface elements such as check boxes, cursors, menus, scrollers, and windows (collectively and commonly referred to as widgets) similarly facilitate the access, operation, and display of data and computer hardware and operating system resources, functionality, and status. Operation interfaces are commonly called user interfaces. Graphical user interfaces (GUIs) such as the Apple Macintosh Operating System's Aqua, Microsoft's Windows XP, or Unix's X-Windows provide a baseline and means of accessing and displaying information graphically to users.

A user interface component is a stored program component that is executed by a CPU. The user interface may be a conventional graphic user interface as provided by, with, and/or atop operating systems and/or operating environments such as Apple Macintosh OS, e.g., Aqua, GNUSTEP, Microsoft Windows (NT/XP), Unix X Windows (KDE, Gnome, and/or the like), mythTV, and/or the like. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Some Web browsers allow for the execution of program components through facilities such as Java, JavaScript, ActiveX, and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the Information Comparator system enabled nodes. The combined application may be nugatory on systems employing standard Web browsers.

Mail Server

A mail server component is a stored program component that is executed by a CPU. The mail server may be a conventional Internet mail server such as, but not limited to send mail, Microsoft Exchange, and/or the like. The mail server may allow for the execution of program components through facilities such as ASP, ActiveX, (ANSI) (Objective-C (++), CGI scripts, Java, JavaScript, PERL, pipes, Python, WebObjects, and/or the like. The mail server may support communications protocols such as, but not limited to: Internet message access protocol (IMAP), Microsoft Exchange, post office protocol (POPS), simple mail transfer protocol (SMTP), and/or the like. The mail server can route, forward, and process incoming and outgoing mail messages that have been sent, relayed and/or otherwise traversing through and/or to the Information Comparator system.

An integrator network entity generally defines a participant of the advertising exchange system that represents or integrates one or more entities on the coupon providing system. For example, an integrator network may represent players on a gaming providing system in order to deliver game content from vendors to consumers or other integrator networks. In some embodiments, the integrator networks are referred to as the "users" of the gaming providing system. The integrated networks may comprise third party agents that operate on behalf of or are part of the integrator network. The term "third party agent" is used to generally describe an agent or customer that participates in transactions on the coupon providing system. Similarly, the term "third party recipient" is used to describe a user or participant of the gaming providing system that receives information from the system, such as coupon requests. However, the terms integrator networks, third party agents and third party recipients is intended to represent a broad class of entities, including all commercial parties that sell, lease, rent, provide services and the like, as well as the agents that represent them, that operate on the gaming providing system.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player. In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

What is claimed:

1. A casino gaming system, comprising:

a stand-alone gaming console comprising an upright display panel housing a video display screen, and a player input area positioned horizontally, below the upright display panel;

player input controls on the player input area, the player input controls receiving one or more wagers, each wager among the one or more wagers memorializing a set of two or more predicted ball drop-and-capture event outcomes;

a ball drop-and-capture gaming system comprising a horizontally rotating physical wheel on the player input area, and configured to execute a set of two or more consecutive physical ball drop-and-capture events based on each wager determine results of the two or more consecutive physical ball drop-and-capture events based on sensor data, and a wager resolution system to resolve each wager by comparing the set of predicted ball drop-and-capture event outcomes to the set of physical ball drop-and capture events, and matching at least two consecutive physical ball drop-and-capture events and two predicted ball drop-and-capture event outcomes, wherein the video display screen is positioned vertically, directly above the ball drop-and-capture gaming system, and comprises a plurality of separate display fields displaying the results of the at least two consecutive ball drop-and-capture events in real time.

2. The casino gaming system of claim 1, further comprising:

the video display screen configured to display, on one or more sections of the video display screen, a wager and a physical ball drop-and-capture event.

3. The casino gaming system of claim 2, wherein the video display screen comprises three sections, each section displaying a distinct result from consecutive physical ball drop-and-capture events.

4. The casino gaming system of claim 2, wherein the display comprises two or more sections, and each section is a distinct color.

5. The casino gaming system of claim 1, wherein the player input controls receive the one or more wagers from one or more players.

6. The casino gaming system of claim 1, wherein the casino gaming system is configured to receive a wager from one player.

7. The casino gaming system of claim 1, wherein the ball drop-and-capture gaming system comprises:

a plurality of compartments on the horizontally rotating physical wheel, wherein each compartment among the plurality of compartments is configured to temporarily secure a ball;

a ball drop system configured to drop at least one ball onto the horizontally rotating physical wheel; and a ball return system configured to remove balls temporarily secured in a compartment.

8. The casino gaming system of claim 7, wherein the ball drop system drops a plurality of balls onto the horizontally rotating physical wheel.

9. The casino gaming system of claim 7, wherein a ball drop-and-capture event outcome corresponds to the compartment within which the ball is temporarily secured.

10. The casino gaming system of claim 7, wherein each compartment is labeled with a different alphanumeric symbol.

11. The casino gaming system of claim 1, wherein:

the video display screen is configured to display on a specific area of the video display screen a physical ball drop-and-capture event, and wherein the player input area is configured to provide separate player input controls identifying options for selection of at least one predicted ball drop-and-capture event outcome.

12. The casino gaming system of claim 1, wherein the player input controls comprise touch-screen areas on the video display screen.

13. The casino gaming system of claim 1, wherein the wager resolution system compares the set of physical ball drop-and-capture events to a set of preselected ball drop-and-capture event outcomes in a paytable.

14. The casino gaming system of claim 12, wherein the wager resolution system matches at least two consecutive physical ball drop-and capture events to the preselected ball drop-and-capture event outcomes in the paytable.

15. A casino gaming method, comprising:

receiving, from player input controls on a stand-alone gaming console, one or more wagers memorializing a set of two or more predicted ball drop-and-capture event outcomes, wherein the stand-alone gaming console comprises an upright video display screen above a horizontal player input area comprising player input controls;

executing, on a ball drop-and-capture gaming system comprising a horizontally rotating physical wheel, a set of two or more consecutive physical ball drop-and-capture events, based on each wager;

determining event outcomes for the set of two or more consecutive physical ball drop-and-capture events based on sensor data received from the ball drop-and-capture gaming system, resolving the wager by at least comparing the set of predicted ball drop-and-capture outcomes to the set of physical ball drop-and capture events, and matching at least two consecutive physical ball drop-and-capture events and two predicted ball drop-and-capture event outcomes, and displaying the at least two consecutive ball drop-and-capture events on separate display fields of the video display screen positioned vertically, directly above the ball drop-and-capture gaming system.

16. The method of claim 15, further comprising:

displaying, on one or more display fields of the video display screen, at least one of the wager and the physical ball drop-and-capture events.

17. The method of claim 15, wherein the ball-drop-and-control gaming system comprises:

a plurality of compartments on the horizontally rotating physical wheel, wherein each compartment among the plurality of compartments is configured to temporarily secure a ball dropped onto the horizontally rotating physical wheel; and an alphanumeric display wheel distributed about a circumference of the horizontally rotating physical wheel, such that align an alphanumeric symbol aligns with each of the compartments.

18. The method of claim 17, wherein the player input system may initiate a rotation of the alphanumeric display wheel, and a position of the alphanumeric spin wheel is locked into a single rotational position before the ball is dropped onto the horizontally rotating physical wheel.

19. The method of claim 15, wherein resolving each wager further comprises:

comparing the set of physical ball drop-and-capture events to a set of preselected ball drop-and-capture event outcomes in a paytable.

20. The method of claim 19, further comprises:

matching at least two consecutive physical ball drop-and capture events to the preselected ball drop-and-capture event outcomes in the paytable.

* * * * *